United States Patent [19]

Notestine

[11] Patent Number: 4,459,719

[45] Date of Patent: Jul. 17, 1984

[54] SWEEPING MACHINE WITH DIRT AND DEBRIS CONTROL FLAP

[75] Inventor: Richard H. Notestine, Toledo, Ohio

[73] Assignee: The Scott & Fetzer Company, Lakewood, Ohio

[21] Appl. No.: 465,930

[22] Filed: Feb. 14, 1983

[51] Int. Cl.[3] ..... E01H 1/04

[52] U.S. Cl. ..... 15/349; 15/83

[58] Field of Search ..... 15/83, 340, 349, 79 A

[56] References Cited

U.S. PATENT DOCUMENTS

| | | | |
|---|---|---|---|
| 2,789,067 | 4/1957 | Link | 15/83 X |
| 3,604,051 | 9/1971 | Wendel et al. | 15/83 X |
| 3,665,545 | 5/1972 | Beekman | 15/340 X |
| 4,310,944 | 1/1982 | Kroll et al. | 15/349 X |
| 4,317,246 | 3/1982 | Knowlton | 15/83 |

*Primary Examiner*—Chris K. Moore

*Attorney, Agent, or Firm*—Allen D. Gutchess, Jr.

[57] ABSTRACT

A sweeping machine with a hopper and a dirt and debris control flap in the hopper. The sweeping machine includes a rotary broom adjacent the hopper opening which receives dirt and debris swept from a surface being cleaned by the broom. The hopper is maintained under negative pressure by a vacuum blower. A filter is also located in the hopper through which air is drawn by the blower. A dirt and debris control flap is pivotally mounted in the hopper with the flap having a first extreme position in which an outer edge of it is spaced adjacent an upper edge of the hopper opening and a second extreme position in which an outer edge is closer to a front end wall of the hopper. When the flap is swung from the first extreme position to the second the outer free edge of the flap moves through an intermediate position close to the bottom wall of the hopper and moves dirt and debris on the bottom wall toward the front end wall. The hopper also has a slanted baffle wall therein which directs air and air-borne dirt to the filter along with the flap, when in its first extreme position. When the hopper is dumped, the flap can be moved from the first extreme position to the second extreme position to enable loose dirt collected on the baffle wall and the flap from the filter to be dumped through the hopper opening.

20 Claims, 3 Drawing Figures

SWEEPING MACHINE WITH DIRT AND DEBRIS CONTROL FLAP

This invention relates to a sweeping machine having a hopper with a dirt and debris control flap therein.

Surface sweeping machines having rotatable brooms with hoppers having moveable flaps within are known in the art. Such are represented by Knowlton U.S. Pat. No. 4,317,246 issued Mar. 2, 1982, and Brown U.S. Pat. No. 3,540,070 issued Nov. 17, 1970.

The present invention is directed to a sweeping machine, preferably of the riding type, having a rotatable broom or brush and a hopper having an opening adjacent the brush to receive dirt and debris therefrom. The hopper is maintained under negative pressure by a vacuum blower which draws air through the hopper opening and through a filter located in an upper portion of the hopper. The filter traps and removes air-borne dirt so that clean air is expelled by the blower.

A moveable dirt and debris control flap is pivotally mounted in the hopper above a bottom wall thereof and forward of the hopper opening. The control flap is pivotally mounted above the bottom wall by a distance slightly exceeding the width of the control flap and is mounted forwardly of the hopper opening by approximately the same distance. The control flap has one extreme position in which the free or outer end of the flap is adjacent an upper edge of the hopper opening. The control flap has a second extreme position toward a forward end wall of the hopper with the angle between the two positions exceeding ninety degrees.

The control flap is affixed to a shaft which is pivotally mounted in side walls of the hopper with a torsion spring at one end of the shaft and preferably located inside the hopper. The other end of the shaft has a lever arm thereon connected to suitable remotely-controlled means for moving the lever between the extreme positions. The torsion spring returns the flap from the second and other positions to the first extreme position. When the control flap is moved by the remote means from the first position to the second position, the free edge thereof moves through an intermediate position with the free edge close to the bottom wall and contacts and sweeps dirt and debris on an intermediate portion of the bottom wall of the hopper toward the front end wall, thus making room for additional dirt and debris and increasing the hopper capacity.

The hopper also has a slanted baffle wall extending between the side walls thereof below the filter and positioned to direct air and air-borne dirt toward the front of the hopper from the hopper opening. The baffle wall also collects dirt which is shaken or dropped from the filter. In the first extreme position, the flap forms an extension, in effect, of this baffle wall, extending from that wall toward the hopper opening and closing off the space therebetween. When the hopper is moved to a dump position, the control flap is moved from the first extreme position to an intermediate position where it is substantially parallel to the slanted baffle wall and directs dirt collected on the slanted wall and on the flap, when in the first extreme position, toward the hopper opening through which the dirt is discharged. Along with the baffle wall, the control flap also controls the flow of air through the hopper, directing it toward the forward wall thereof when the flap is in the first extreme position.

It is, therefore, a principal object of the invention to provide a sweeping machine with a hopper having a moveable control flap therein which sweeps dirt and debris on a bottom wall of the hopper toward a forward wall thereof.

Another object of the invention is to provide a sweeping machine with a hopper having a filter therein, with a baffle wall therebelow and a moveable control flap which direct air through the hopper and direct dirt collected from the filter toward a hopper opening when the hopper is in the dumping position.

Many other objects and advantages of the invention will be apparent from the following detailed description of a preferred embodiment thereof, reference being made to the accompanying drawings, in which.

Figure 1:
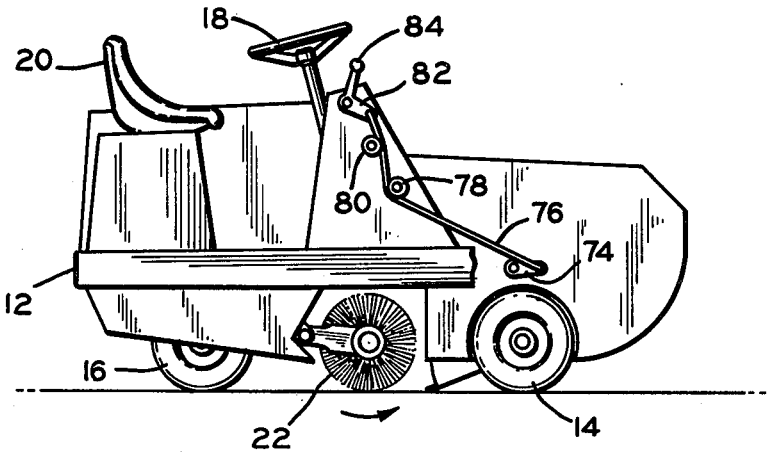
FIG. 1 is a somewhat schematic side view in elevation of a sweeping machine embodying the invention.

Referring particularly to FIG. 1, a riding sweeping machine embodying the invention is indicated at 10. The machine includes a main frame or body 12 with forward wheels 14 and a central rear wheel 16 which is steered by a steering wheel 18 located in front of an operator's seat 20. Side brooms (not shown) can be located in front of the wheels 14, if desired, and a rotatable sweeping brush or broom 22 is located to the rear of the wheels 14.

Figure 2:
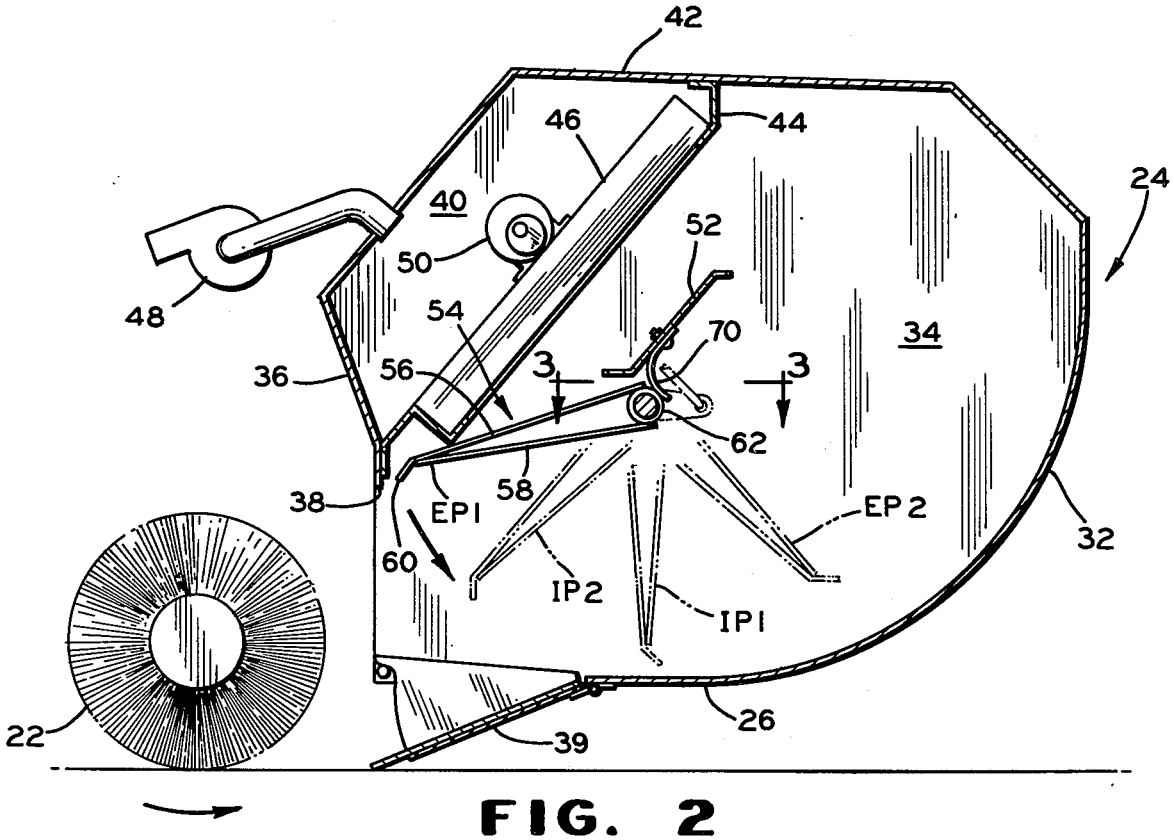
FIG. 2 is an enlarged view in central cross section taken through the hopper of the machine.

A hopper 24 (FIG. 2) is positioned near the rotatable brush 22 to receive dirt and debris therefrom. The hopper 24 includes a bottom wall 26, side walls 28 and 30, and a forward wall 32 defining a receptacle 34 for the dirt and debris. The hopper also includes a rear end wall 36 which defines a dirt and debris-receiving opening 38 of the hopper along with the side walls 28 and 30 and the bottom wall 26.

A moveable or pivotable lip 39 is pivotally connected to the bottom wall 26 and, in effect, forms an extension thereof, extending to the lower edge of the hopper opening 38. The lip 39 swings upwardly when the sweeper encounters larger debris and then pivots downwardly again under gravity, as is known in the art.

A vacuum chamber 40 is defined in an upper, rear portion of the hopper 24 by the side walls 28 and 30, the rear end wall 36, and an upper wall 42 along with a filter frame 44 on which a suitable filter 46 is mounted. The filter 46 removes air-borne dirt from air drawn through the hopper opening 38 by a suitable exhaust or vacuum blower 48. When the filter 46 is shaken, as by a shaker motor 50, dirt falls downwardly in part onto an upper surface of a slanted baffle wall 52 slanted toward the hopper opening 38 and extending between the side walls 28 and 30.

A dirt and debris control flap 54 in accordance with the invention is moveably mounted in the hopper 24. The control flap includes a longer main plate 56 and a stiffener plate 58, the former curving toward the latter in a lip 60. The plates 56 and 58 have the edges opposite the outer lip 60 affixed to a sleeve 62 which, in turn, is affixed to a shaft 64. The shaft 64 is rotatably mounted in bearings 66 and 68 (FIG. 3) in the hopper side walls 28 and 30.

The shaft 64 is positioned in the hopper such that the flap 54 is pivotally mounted above the bottom wall 26 by a distance slightly in excess of the width of the flap. The shaft is also positioned forwardly of the rear hopper wall 36 by about the same distance. With this position of the control flap 54, an outer edge portion thereof is in contact with a lower portion of the filter frame 44 with the lip 60 near the upper edge of the hopper opening 38 when the flap is in a first extreme position designated EP1. The flap 54 has a second extreme position in which it slants toward the forward end wall 32 of the hopper, this position being designated EP2, with the distance between the two extreme positions exceeding 90°.

In the first position, the flap closes off the space between the slanted wall 52 and the filter 46, directing air drawn through the hopper opening 38 toward the forward end of the hopper and up and back to the filter. A flexible sealing strip 70 is affixed to the wall 52 and contacts the flap sleeve 62 to prevent short circuiting of the air through the narrow space between the pivoted edge portion of the flap 54 and the lower rear edge of the slanted wall 52. In the first position, the flap 54 also collects dirt from the filter 46.

The primary purpose of the control flap 54 is to move dirt and debris, particularly lighter debris, on the bottom wall 26 toward the forward wall 32 of the hopper to make room for additional dirt and debris thrown from the rotatable brush 22. Hence, the position of the flap 54 is such that when it moves from the first extreme position EP1 to the second extreme position EP2, it passes through an intermediate position designated IP1. In this position, the flap 54 is substantially vertical and the lip 60 thereof is close to the bottom wall 26 so as to contact the dirt and debris as the flap is swung from the first extreme position EP1 to the second extreme position EP2 and thereby throws the debris forwardly into the forward portion of the hopper.

The control flap 54 has a second intermediate position designated IP2 in which it is approximately parallel to the slanted wall 52. The flap 54 is moved to the second intermediate position when the hopper is raised and pivoted in a counterclockwise direction to dump the dirt and debris in the hopper out of the opening 38. Thus dirt from the hopper 50 collected on the slanted wall 52 and on the upper surface of the flap plate 56 is directed through the opening 38 along with the other dirt and debris.

Figure 3:
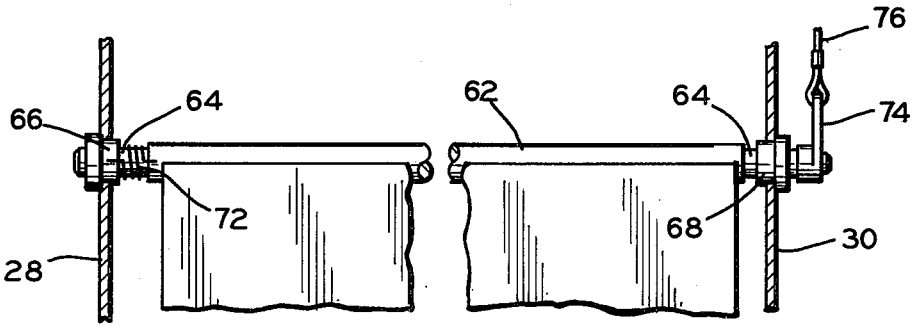
FIG. 3 is a fragmentary view of a control flap in the hopper, taken along the line 3—3 of FIG. 2.

In a preferred form, the control flap 54 is urged toward the first extreme position EP1 from any other position by resilient means shown as a torsion spring 72 in FIG. 3. Hence, during normal sweeping operations, the control flap 54 remains in this position.

Suitably remotely-controlled moving means are also provided for moving the flap 54 from the first extreme position to the second intermediate position IP2 or through the intermediate position IP1 to the extreme position EP2. The control flap 54 is moved in this motion only occasionally during sweeping operations to clear debris from the bottom wall 26 and move it toward the front forward wall of the hopper. As shown, the remotely-controlled moving means for the control flap 54 includes a lever arm 74 affixed to an end of the shaft 64 outside the hopper wall 30. A flexible cable 76 is connected to the outer end of the arm 74 and is positioned around suitable guide rollers or pulleys 78 and 80 (FIG. 1) and connected to an operating lever 82. This lever is pivotally connected to the sweeper within reach of the operator and has a handle 84 for the operator to grasp. When the operator pulls back on the handle 84, the control flap 54 is moved toward the extreme position EP2 and when the lever 84 is released, the torsion spring 72 returns the flap 54 to the first extreme position EP1. The cable 76 is preferably located such that it will not exert a force on the shaft lever arm 74 when the hopper is raised to the dumping position. The position of the flap 54 then remains entirely within the control of the operator.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. In a machine for sweeping a surface comprising a frame, wheel means supporting the frame on the surface, a rotatable sweeping brush carried by said frame, a hopper carried by said frame near said sweeping brush, said hopper defining a dirt and debris-receiving chamber and an opening near said sweeping brush through which dirt and debris are received from said brush, the improvement comprising a control flap pivotally mounted in said hopper above a bottom wall thereof, said flap having one position in which an outer edge thereof spaced from the pivot is near an upper edge of said opening and another position in which said outer edge is closer to the front of said hopper, said flap having an intermediate position in which said outer edge is positioned close to said bottom wall, whereby when said flap is moved from said one position to said another position, said flap moves through said intermediate position to move debris on said bottom wall toward said forward end wall, and means for moving said flap among the positions.

2. A machine according to claim 1 characterized by resilient means for urging said flap toward said one position.

3. A machine according to claim 1 characterized by said flap being pivotally mounted on a shaft rotatably journaled in side walls of said hopper.

4. A machine according to claim 3 characterized by resilient means associated with said shaft inside said hopper for urging said flap toward said one position.

5. A machine according to claim 4 characterized by said resilient means being located inside said hopper adjacent one of said side walls, and said moving means comprising a lever arm engageable with said shaft outside said hopper adjacent the other of said side walls for moving said flap.

6. A sweeper according to claim 5 characterized further by said moving means comprising a cable connected to said lever arm and a control lever adjacent an operator's position and connected to said cable for moving said lever arm and said flap from said one position toward said another position.

7. A machine according to claim 1 characterized by filter means positioned in said hopper above said flap, and a baffle wall extending across said hopper below said filter means and partially above said flap, said baffle wall and said flap retaining dirt thereon from said filter means when said flap is in said one position.

8. A machine according to claim 7 characterized by said baffle wall being positioned in said hopper such that when said hopper is moved to a raised, dumping position, and said flap is spaced from said one position, dirt from said filter means on said baffle wall will be dumped along with dirt from said filter means on said flap through said hopper opening.

9. A machine according to claim 8 characterized by a sealing strip extending between said baffle wall and a pivoted edge portion of said control flap.

10. In a machine for sweeping a surface comprising a frame, wheel means supporting the frame on the surface, a rotatable sweeping brush carried by said frame, a hopper carried by said frame near said sweeping brush and defining a dirt-and debris-receiving chamber and an opening near said rotatable brush through which dirt and debris are received from said brush, a filter extending across said hopper, a baffle wall extending across said hopper below said filter and spaced from said hopper opening, and vacuum means for drawing air through said hopper opening, said chamber, and said filter, the improvement comprising a control flap pivotally mounted in said hopper below said filter and having one position in which an outer edge thereof spaced from said pivot is near an upper portion of said hopper opening, said flap closing the space between said baffle wall and said hopper opening when said flap is in said one position, and means for moving said flap away from said one position to enable dirt on said baffle wall and on said flap from said filter to discharge through said hopper opening when said hopper is in a raised, dumping position.

11. A machine according to claim 10 characterized by said control flap having another position in which said outer edge of said flap is closer to a forward end of said hopper and said flap having an intermediate position in which said outer edge is close to a bottom wall of said hopper.

12. A machine according to claim 10 characterized by resilient means for urging said flap toward said one position.

13. A machine according to claim 10 characterized by said flap being pivotally mounted on a shaft rotatably journaled in side walls of said hopper, and resilient means associated with said shaft for urging said flap toward said one position.

14. A machine according to claim 13 characterized by said moving means comprising a lever arm engageable with said shaft outside said hopper adjacent a side wall thereof for moving said flap.

15. A sweeper according to claim 14 characterized further by said moving means comprising a cable connected to said lever arm and a control lever adjacent an operator's position and connected to said cable for moving said lever arm and said flap away from said one position.

16. A machine according to claim 10 characterized by a flexible sealing strip extending between said dirt-collecting wall and a pivoted edge portion of said control flap.

17. In a machine for sweeping a surface comprising a frame, wheel means supporting the frame on the surface, a rotatable sweeping brush carried by said frame, a hopper carried by said frame near said sweeping brush, said hopper comprising a bottom wall, side walls, a top wall, a forward wall, and a rear wall, a filter in said hopper extending between said side walls, said hopper defining a dirt and debris-receiving chamber and an opening near said sweeping brush through which dirt and debris are received from said brush, said hopper further defining a filter chamber with said filter on the side of said filter opposite said dirt and debris-receiving chamber, vacuum means communicating with said filter chamber for drawing air through said hopper opening, through said dirt and debris-receiving chamber, through said filter, and through said filter chamber with air-borne dirt collected on said filter on the side toward said dirt and debris-receiving chamber, and a baffle wall extending across said filter, said baffle wall having a forward edge toward the forward wall of said chamber and a rear edge toward the rear wall of said chamber, the improvement comprising a control flap pivotally mounted in said chamber above said bottom wall and near the rear edge of said baffle wall, said flap having a first extreme position in which said flap closes the space between said rear edge of said baffle wall and an upper edge portion of said hopper opening, said flap having a second extreme position in which an outer edge thereof is spaced closer to the forward wall of said hopper, with said extreme positions defining an angle of more than 90°, said flap having a first intermediate position in which said outer edge of said flap is positioned close to said bottom wall, and said flap having a second intermediate position in which the outer edge is spaced below the upper edge of said hopper opening, whereby filter dirt collected on said baffle wall and on said flap can be directed outside said hopper opening when said hopper is in a dumping position, said flap also being effective to move debris from said bottom wall toward said forward wall when said control flap is moved from said first extreme position to said second extreme position through said first intermediate position, and remotely-controlled means for moving said flap.

18. A machine according to claim 17 characterized by said control flap being pivotally mounted on a shaft carried by said hopper, and resilient means engageable with said shaft for urging said flap toward said first extreme position.

19. A machine according to claim 18 characterized by said remotely controlled means comprising a lever arm engaged with said shaft for moving said flap away from said first extreme position.

20. A machine according to claim 17 characterized by said baffle wall slanting downwardly toward said hopper opening with the forward edge being higher than the rear edge.

* * * * *